US006244312B1

(12) United States Patent
Hoffman

(10) Patent No.: US 6,244,312 B1
(45) Date of Patent: Jun. 12, 2001

(54) PROCESSING MEANS FOR BARKING MACHINES

(75) Inventor: Frank Hoffman, NjutÅnger (SE)

(73) Assignee: Iggesund Tools AB, Iggesund (SE)

( * ) Notice: Subject to any disclaimer, the term of this patent is extended or adjusted under 35 U.S.C. 154(b) by 0 days.

(21) Appl. No.: 09/348,559

(22) Filed: Jul. 7, 1999

(30) Foreign Application Priority Data

Jul. 8, 1998 (SE) ..... 9802451

(51) Int. Cl.[7] ..... B27L 1/00
(52) U.S. Cl. ..... 144/208.8; 144/241; 144/341
(58) Field of Search ..... 144/24.13, 208.1, 144/208.8, 341, 343, 241

(56) References Cited

U.S. PATENT DOCUMENTS

| | | | | |
|---|---|---|---|---|
| 3,026,919 | * | 3/1962 | Lunn | 144/208.8 |
| 4,852,622 | | 8/1989 | Erickson . | |
| 5,460,212 | * | 10/1995 | Darden | 144/241 |
| 5,893,401 | * | 4/1999 | Eriksson | 144/208.8 |

FOREIGN PATENT DOCUMENTS 463660 1/1991 (SE) .
511505 10/1999 (SE) .

* cited by examiner

*Primary Examiner*—W Donald Bray
(74) *Attorney, Agent, or Firm*—Fitzpatrick, Cella, Harper & Scinto

(57) ABSTRACT

The present invention relates to a processing means for barking machines of the type having a plurality of swinging arms, each being at an inner end pivotally mounted on a rotatable, annular rotator, while at an opposite outer free end, they carry such a processing means and are actuated by a spring load which strives to pivot the outer end inwards to the axis of rotation of the rotator. The processing means comprises a front, a rear, an upper and a lower surface, which are designed in such manner that an edge serving as a processing edge is defined between the front and the upper surface. The, lower surface is formed with an engaging means which is adapted to engage a matching formation in a seat in the outer end of the swinging arm. The rear surface acts as a supporting surface which serves to abut against a corresponding swinging arm supporting surface which is directed forwards or obliquely forwards against the direction of feed of the logs. The engaging means comprises a ridge or a groove and is rectilinear and elongate in such manner that its total length exceeds its height or depth, and preferably also its width, at least by a factor ten. The engaging means further extends at an acute angle of at least 10° in relation to the rear surface.

15 Claims, 2 Drawing Sheets

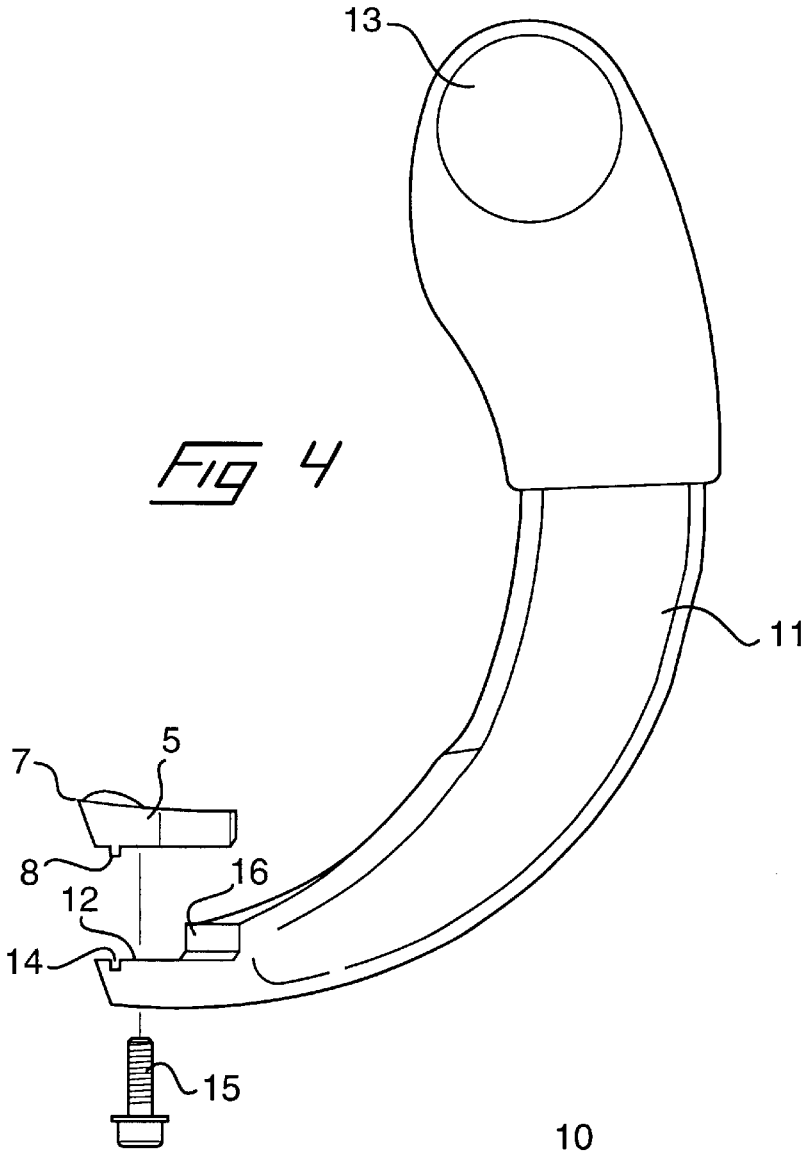
Fig 4
Fig 5
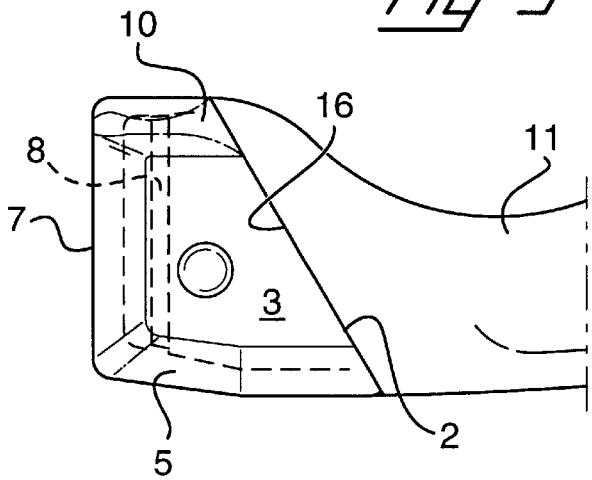

PROCESSING MEANS FOR BARKING MACHINES

FIELD OF THE INVENTION

The present invention relates to a processing means for barking machines of the type having a plurality of swinging arms, each being at an inner end pivotally mounted on a rotatable, annular rotator, while at an opposite free outer end, they carry such a processing means and are actuated by a spring load striving to pivot the outer end inwards to the axis of rotation of the rotator, comprising a front, a rear, an upper and a lower surface which are designed in such manner that an edge serving as a processing edge is defined between the front and the upper surface, that the lower surface is formed with an engaging means which is adapted to engage a matching formation in a seat in the outer end of the swinging arm, and that the rear surface acts as a supporting surface serving to abut against a corresponding swinging arm supporting surface which is directed forwards or obliquely forwards against the direction of feed of the logs.

BACKGROUND ART

Exchangeable processing means for barking machines of the type mentioned by way of introduction are subjected to great loads during barking, and it is thus most important for these to be fixed in such manner that there is no risk of their coming loose during barking. The rotator normally rotates at high speed, and a processing means which comes loose may therefore cause great damage. The processing means are subjected, inter alia, to forwardly directed forces when shearing off bark from a log, to rearwardly directed forces after the swinging arm has been pivoted away from the log surface because of an irregularity in the circumferential surface of the log and is again pivoted inwards at high speed and hits the log surface, and to laterally directed forces in the direction of feed of the logs when they are hit by the end surface of logs arriving at the barking machine.

Since, after being used for some time, the processing means become worn and are rejected to be replaced by new ones, it is desirable that they be as inexpensive as possible. On the one hand, they should have as small dimensions as possible for a given length of the barking processing edge so that the volume of material becomes small and, on the other hand, they should be as easy as possible to manufacture. As a rule, the processing means are manufactured by forging a blank to a suitable shape and size and finally machining this by milling. From the viewpoint of cost, it is advantageous for the forged blank to have a shape which conforms as well as possible with the finished processing means, so that only a small amount of material need be removed in the final machining. Moreover, it will be time-saving and reduce the number of machining steps if the finished processing means has as simple a geometric shape with as large and continuous planar surfaces as possible and straight edges between the surfaces.

An individual processing means is usually fixed by means of a single bolt which is passed through the same and the swinging arm. In most cases, it is desirable to use a bolt having as small a diameter as possible, and therefore the processing means and the swinging arm are designed so that the bolt needs to absorb only tensile forces which are directed perpendicular to the upper and lower surfaces of the processing means. These forces are relatively small and give rise to pure tensile forces which a bolt is well suited to manage. On the other hand, the forwardly, rearwardly and laterally directed forces are considerably greater. To prevent deformation and any fracture of the bolt or turning round the same, the processing means and the seats of the swinging arms are designed in such manner that these forces are absorbed by the swinging arms.

This is accomplished in certain types of processing means by mounting them in cup-shaped seats of the swinging arms. Processing means of the type mentioned by way of introduction, however, have the advantage that, for instance, they can be made with smaller dimensions for a given length of the barking edge, With a view to absorbing forwardly, rearwardly and laterally directed forces, they are formed with a supporting surface which is directed backwards or, preferably, obliquely backwards and which is adapted to abut against a swinging arm supporting surface which is directed forwards or obliquely forwards against the direction of feed of the logs, and some sort of engaging means between the lower surface of the processing means and the seat of the swinging arm.

It is previously known to design the engaging means as, for instance, a projection with an elongate, rounded shape in the area round the fixing bolt, as disclosed in, for instance, SE 463,660 and the US counterpart U.S. Pat. No. 4,852,622, which engages a correspondingly formed recess in the seat of the swinging arm. With such an engaging means, a deep and complicated machining is required of the processing means as well as the swinging arm.

It is also known from SE 9703183-5 to bore a hole in the lower surface of the processing means as well as in the seat of the swinging arm and arrange a pin in the holes to prevent turning of the processing means in relation to the swinging arm. Such an engaging means certainly yields relatively little and simple machining, but is felt by the users to be complicated in dismounting of worn processing means and mounting of new ones. On the one hand, they can get stuck by pinching owing to rests of trees being wedged between the processing means and the swinging arm, which makes the processing means so difficult to dismount that they must be knocked away and, on the other hand, they can be difficult to fit during mounting.

SUMMARY OF THE INVENTION

The present invention aims at obviating problems and drawbacks of prior-art processing means of the type mentioned by way of introduction and providing a processing means which is inexpensive to manufacture owing to the possibility of forming it with advantageously small dimensions and with a small volume of material for a given length of the processing edge and yields simple and minimal final machining of the blanks. Moreover, the invention aims at a processing means with an engaging means which, in cooperation with the supporting surface which is directed backwards or obliquely backwards and an arbitrary fixing means, results in reliable and distinct fixing of the processing means against the action of any existing forwardly, rearwardly and laterally directed forces. It is also an object to provide a processing means which is easily and quickly mountable on and dismountable from the swinging arm. At least these objects are achieved by a processing means according to claim 1.

According to the general inventive idea, the engaging means has the form of a straight, elongate ridge or a groove on the underside of the processing means, which engages a groove or a ridge in the seat of the swinging arm. The engagement means is rectilinear and elongate so that its length is at least ten times greater than its height or depth.

Further the engaging means is extended at an angle of at least 10°, preferably at least 20° and most prefer-red at least 30° in relation to the rear surface. The acute angle between the engaging means and the rear surface also faces or is oriented in the direction of feed of the logs. The engaging means and the rear surface will consequently define a distinct end position of the position of the processing means in the seat of the swinging arm and thus absorb laterally directed forces which arise when arriving logs bump against the swinging arms with their end surfaces. In the opposite direction, i.e. against the direction of feed, existing forces, if any, are small and can easily be absorbed by the fixing means, for instance, a bolt which holds the processing means on the swinging arm.

According to the general inventive idea, the engaging means can have a relatively great width in relation to its height and depth, respectively. However, the width of the engaging means, as well as its height and depth, respectively, is smaller than its length preferably at least by a factor ten. This facilitates a space- and material-saving design of the processing means.

By making the engaging means narrow and elongate, the advantage is obtained that it requires a small space in the longitudinal direction of the processing means, i.e. perpendicular to the processing edge. The length of the processing means can thus be short, which is advantageous from the viewpoint of saving of material.

In a preferred embodiment, the processing means is almost triangular, the rear surface being extended at an angle of at least 10°, preferably at least 20° and most preferred at least 30° in relation to the barking edge with the resulting long lateral surface facing the direction of feed of the logs. The engaging means is in turn located parallel with the barking edge and thus obtains the desired angle in relation to the rear surface.

In a preferred embodiment, the engaging means extends over the entire width of the processing means, i.e. from one lateral edge to the opposite, This is advantageous from the viewpoint of machining and permits forming of the processing means in a minimum number of machining steps. It is also preferred for the engaging means to be continuous along its entire length, but a small break would be possible within the scope of the invention. Preferably the height and depth, respectively, of the engaging means is at most 5 mm, preferably at most 4 mm, and most preferred at most 3 mm. It is also preferred that the width of the engaging means is at most 5 mm, preferably at most 4 mm, and most preferred at most 3 mm, but as mentioned above, it is also possible to let the width of the engaging means be considerably greater.

In a preferred embodiment according to claim 5, the engaging means has the shape of a ridge which engages a correspondingly formed and extended groove in the seat of the swinging arm. This is advantageous compared with an engaging means in the form of a groove, by the processing means thus being given an optimally small thickness, which saves material. A groove has the quality of acting as a fracture line, and the cross-section along the groove will be dimensioning for the total thickness of the processing means. Although the engaging means has the shape of a ridge, it is possible to hold the machining at a material-saving low level owing to the possibility of forging the blanks, owing to their simple geometric shape, to a shape which conforms well with the shape of the finished processing means, which requires a small degree of machining. In a preferred embodiment, the ridge is rectangular or square in cross-section, but also other cross-sectional shapes, such as semicircular, would be conceivable.

By forming the processing means with an engaging means in the form of a groove or a ridge which is rectilinear, elongate and shallow or low, and preferably also narrow, and which further extends at an angle to the rear surface, a number of advantages are thus achieved. When mounting, the engaging means is placed in the corresponding formation in the seat of the swinging arm, and then the processing means is moved laterally until the rear surface engages the corresponding supporting surface of the swinging arm, whereupon the processing means is fixed and pressed against the seat with the aid of the fixing means at issue. When dismounting, the processing means is easily removed, and there is no risk of its being wedged onto the swinging arm in operation. The great length of the engaging means further results in a great moment against turning of the processing means and allows from the viewpoint of strength that the engaging means can be formed both narrow and low and shallow, respectively, which as mentioned above is advantageous from the viewpoint of saving of material and saving of space and requires a small degree of machining of the blanks Preferably, the lower surface on both sides of the engaging means is essentially planar and smooth. This is not absolutely necessary but simplifies the machining in manufacture. For the same reason, it is preferred that the rear surface is planar and smooth.

BRIEF DESCRIPTION OF THE DRAWINGS

In the drawings,

FIG. 4 is a side view of a swinging arm and a processing means, which for the sake of clarity has been moved a distance away from the associated seat of the swinging arm; and FIG. 5 is a top plan view of the outer free end of the swinging arm with the processing means mounted, of which the contours of the underside are indicated by dashed lines.

DETAILED DESCRIPTION OF A PREFERRED EMBODIMENT OF THE INVENTION

Figure 1:
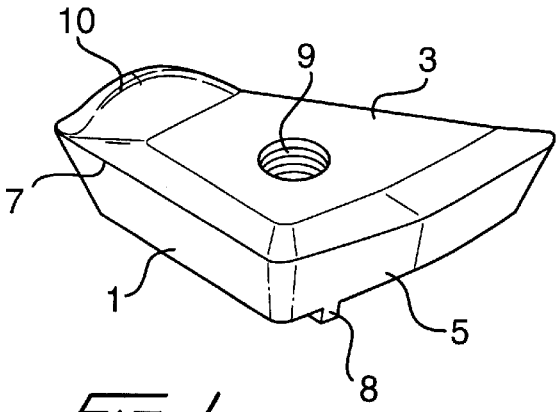
FIG. 1 is a perspective view, as seen obliquely from above, of a processing means according to a preferred embodiment of the invention.
Figure 2:
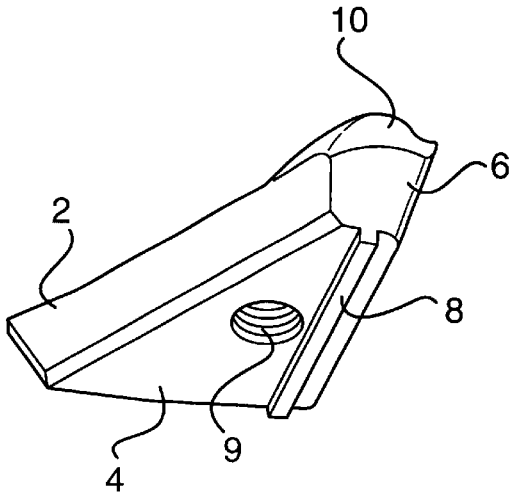
FIG. 2 is a perspective view, seen obliquely from below, of the processing means in FIG. 1.
Figure 3:
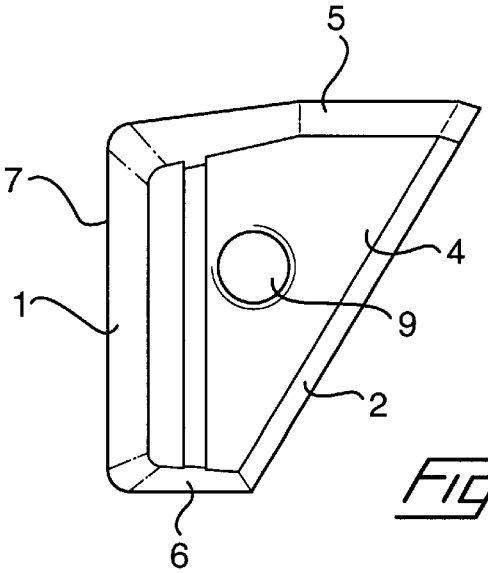
FIG. 3 is a bottom plan view of the processing means according to FIGS. 1 and 2.

Reference is first made to FIGS. 1–3, which show a processing means, according to a preferred embodiment of the invention. The processing means, which is sometimes also referred to in the art as a debarker tool or debarking means, comprises a front surface 1, a rear surface 2, an upper surface 3, a lower surface 4 and two lateral surfaces 5 and 6, respectively. An edge 7 serving as a processing edge is defined between the front surface 1 and the upper surface 3.

As is best seen in FIG. 3, in which the processing means is shown in a bottom plan view, the processing means is essentially triangular with the rear surface extended at an angle of about 30° in relation to the front surface 1 and the processing edge 7, which results in the lateral surface 5 being considerably longer than the lateral surface 6.

The lower surface 4 is formed with a ridge 8, which extends in parallel with the front surface 1 and the processing edge 7. The ridge is rectilinear, extends continuously over the width of the entire processing means between the two lateral surfaces 5, 6 and is square or rectangular in cross-section. The dimensions of the ridge may vary according to the dimensions of the processing means. According to the invention, the length of the ridge is essentially greater than its height, more specifically, the length is at least ten times greater than its height. Preferably, the length of the ridge is also essentially greater or at least ten times greater than its width. Thus, the ridge can in a concrete embodiment be imagined to have a length of about 45 mm while its width and height, respectively, may amount to about 3 mm.

The processing means also has a threaded through hole 9 which extends between the upper and the lower surface, and a bead 10 on the upper surface 3 adjacent to the short lateral surface 6, said bead serving to counteract penetration of the processing edge into the wood as described in more detail in SE 9703183-5.

Then reference is made to FIGS. 4 and 5, which illustrate, in a side view and a top plan view, respectively, the intended position of the processing means on the outer free end of a swinging arm 11. The processing means is mounted with its lower surface 4 engaging a seat 12 of the swinging arm and with the front surface 1 and the processing edge 7 directed forwards in relation to the swinging arm. The swinging arm, together with further swinging arms, usually five in total, is pivotally mounted on a pivot 13 at its inner end on a rotatable annular rotator (not shown). It is also actuated by a spring load inwardly towards the axis of rotation of the rotator, so that the edge of the processing means during barking will be pressed against the circumferential surface of an unbarked log. During simultaneous rotation of the rotator and longitudinal feed of the log through the rotator, bark is thus shorn off from the log.

In the seat 12 a groove 14 is formed, which is adapted to receive the ridge 8 with a close fit, i.e. its width corresponds with a minimum overmeasure to the thickness of the ridge while its depth is greater than the height of the ridge.

The processing means is exchangeably fixed to the swinging arm by means of a bolt 15, which extends through a through hole (not shown) in the swinging arm and is screwed into the hole 9 in the processing means.

A supporting surf ace, designated 16, of the swinging arm extends at the same angle in relation to the groove 14 as the angle between the ridge 8 of the processing means and its rear surface 2 and also has the same angle in relation to the seat 12 as the angle between the rear and lower surfaces 2 and 4, respectively of the processing means. In the mounted state with the bolt 15 passed through the hole in the swinging arm and screwed into the hole 9 of the processing means, the processing means is positioned as shown in FIG. 5. In this position, the ridge 8 is fitted in the groove 14 while at the same time the rear surface 2 abuts against the supporting surface 16 of the swinging arm.

The long lateral surface 5 of the processing means is adapted to face the direction of feed of the logs while the acute angle between the ridge 8 and the rear surface 2 and, respectively, between the groove 14 and the supporting surface 16 is oriented in the direction of feed of the logs. As a result, the ridge 8 and the rear surface 2 will, in cooperation with the groove 14 and the supporting surface 16, define a stop position or end position of the processing means in the direction of feed in such manner that forces directed in the direction of feed in parallel with the processing edge, for instance, impact forces applied on the long lateral surface 5 of the processing means by the end surfaces of logs arriving at the barking machine, are transferred directly to the swinging arm without acting on the fixing bolt 14 with transverse forces. In a similar manner, forces in the longitudinal direction of the swinging arm which act on the processing means and are directed forwards or backwards will be transferred directly to the swinging arm without acting on the fixing bolt with transverse forces.

Mounting and dismounting of the inventive processing means is carried out quite easily and rapidly. In mounting, the ridge 8 is placed in the groove 14 of the swinging arm, whereupon the processing means is moved sideways in the direction of feed of the logs until the rear surface 2 abuts against the supporting surface 16. In this position, the hole 9 through the swinging arm and the hole through the processing means are aligned with each other, and the bolt 15 can be fitted in the holes and tightened. In dismounting, it is easy to raise the processing means or move it sideways against the direction of feed after removal of the bolt 15. There is no risk that the processing means, owing to rests of trees, will be wedged onto the swinging arm and thus difficult to remove.

What is claimed is:

1. A debarking processing tool for use in log barking machines of the type having a plurality of swinging arms, each swinging arm having an inner end pivotally mounted on a rotatable, annular rotator, and an opposite free outer end including a seat for supporting a debarking processing tool, said swinging arms being actuated by a spring load means for pivoting the outer end inwards towards the axis of rotation of the rotator, said debarking processing tool having front, rear, upper and lower surfaces and a processing edge formed thereon between the front and the upper surfaces, said lower surface including an engaging means for engaging a matching formation in said seat in the outer end of the swinging arm, and said rear surface defining a supporting surface abutting against a corresponding swinging arm supporting surface which is directed forwards or obliquely forwards against the direction of feed of the logs, said engaging means being formed as one of either a ridge or a groove shape being rectilinear and elongated with its total length exceeding its height or depth at least by a factor ten, and extending at an acute angle of at least 10° in relation to the rear surface of the tool.

2. A tool as claimed in claim 1, wherein the total length of said engaging means exceeds its width by a factor ten.

3. A tool as claimed in claim 2, wherein the angle between the rear surface and the engaging means is a least 20° and preferably at least 30°.

4. A tool as claimed in any one of claims 1, 2 or 3, wherein the angle between the rear surface and the engaging means faces opens in the direction of feed of the logs.

5. A tool as claimed in any one of claims 1, 2 or 3, wherein the engaging means is a ridge adopted to be received in a correspondingly formed and extended groove in the seats of a swinging arm.

6. A tool as claimed in any one of claims 1, 2 or 3, wherein the height and depth, respectively, of the engaging means is at most 5 mm.

7. A tool as claimed in any one of claims 1, 2 or 3, wherein the engaging means is at most 5 mm.

8. A tool as claimed in any one claims 1, 2 or 3, wherein the engaging means extends over essentially the entire width of the tool.

9. A tool as claimed in any one of claims 1, 2 or 3, wherein the engaging means extends parallel to the processing edge.

10. A tool as claimed in any one of claims 1, 2, or 3, wherein the rear surface extends obliquely at an angle of at least 10° in relation to the processing edge.

11. A tool as claimed in any one of claims 1, 2 or 3, including a single bolt means extending through the tool for securing the tool to the swinging arm.

12. A tool as claimed in claim 7, wherein the width of the engaging means is at most 4 mm.

13. A tool as claimed in claim 7 wherein the width of the engaging means is at most 3 mm.

14. A tool as claimed in claim 10 wherein the rear surface extends obliquely at an angle of at least 20° in relation to the processing edge.

15. A tool as claimed in claim 10 wherein the rear surface extends obliquely at an angle of at least 30° in relation to the processing edge.

* * * * *